US009714662B2

(12) United States Patent
Kurihara

(10) Patent No.: US 9,714,662 B2
(45) Date of Patent: Jul. 25, 2017

(54) TURBOCOMPRESSOR AND TURBOREFRIGERATOR FOR SIMPLIFIED LABOR AND REDUCED COST

(75) Inventor: Kazuaki Kurihara, Tokyo (JP)

(73) Assignee: DAIKIN INDUSTRIES, LTD. (JP)

( * ) Notice: Subject to any disclaimer, the term of this patent is extended or adjusted under 35 U.S.C. 154(b) by 578 days.

(21) Appl. No.: 13/578,838

(22) PCT Filed: Feb. 17, 2011

(86) PCT No.: PCT/JP2011/053371
§ 371 (c)(1),
(2), (4) Date: Oct. 11, 2012

(87) PCT Pub. No.: WO2011/102412
PCT Pub. Date: Aug. 25, 2011

(65) Prior Publication Data
US 2013/0039746 A1 Feb. 14, 2013

(30) Foreign Application Priority Data
Feb. 17, 2010 (JP) ..... 2010-032511

(51) Int. Cl.
*F04D 25/02* (2006.01)
*F04D 17/12* (2006.01)
(Continued)

(52) U.S. Cl.
CPC ..... *F04D 25/02* (2013.01); *F04D 17/122* (2013.01); *F04D 25/06* (2013.01);
(Continued)

(58) Field of Classification Search
CPC ..... F25B 1/053; F25B 1/10; F25B 31/006; F25B 31/026; F25B 2400/07
(Continued)

(56) References Cited

U.S. PATENT DOCUMENTS 2,400,830 A * 5/1946 Kinnucan et al. ..... 123/561
3,728,857 A * 4/1973 Nichols ..... 62/469
(Continued)

FOREIGN PATENT DOCUMENTS

JP 62-093499 4/1987
JP 6-221295 8/1994
(Continued)

OTHER PUBLICATIONS

International Search Report and Written Opinion mailed May 17, 2011 in corresponding PCT International Application No. PCT/JP2011/053371.
(Continued)

*Primary Examiner* — Cassey D Bauer
(74) *Attorney, Agent, or Firm* — Ostrolenk Faber LLP

(57) ABSTRACT

Provided is a turbocompressor (4) having a drive part (12) generating rotational power, an impeller (22*a*) to which the rotational power of the drive part (12) is transmitted to rotate, a plurality of gears (31, 32) transmitting the rotational power of the drive part (12) to the impeller (22*a*), and a drive part casing (13) in which the drive part (12) is installed. This turbocompressor (4) includes an impeller casing (22*e*) installed around the impeller (22*a*), and a gear casing (33) configured to be formed independently of the impeller casing (22*e*) and the drive part casing (13), to couple the impeller casing (22*e*) and the drive part casing (13), and to form an accommodation space (33*a*) in which the plurality of gears (31, 32) are accommodated. With this configuration, in manufacturing the turbocompressor, a working process can be simplified and working labor and cost can be reduced.

9 Claims, 4 Drawing Sheets

(51) Int. Cl.
*F04D 25/06* (2006.01)
*F04D 29/62* (2006.01)
*F04D 25/16* (2006.01)

(52) U.S. Cl.
CPC ..... *F04D 25/0606* (2013.01); *F04D 25/163* (2013.01); *F04D 29/624* (2013.01)

(58) Field of Classification Search
USPC ..... 62/498, 505, 508
See application file for complete search history.

(56) References Cited

U.S. PATENT DOCUMENTS 3,809,493 A 5/1974 Pilarczyk ..... 415/199
3,922,117 A * 11/1975 Weatherston ..... 418/9
6,619,072 B2 * 9/2003 Seki et al. ..... 62/498
6,634,853 B1 * 10/2003 Anderson ..... 415/70
7,469,689 B1 * 12/2008 Jones et al. ..... 123/559.1
2009/0193840 A1 * 8/2009 Kurihara et al. ..... 62/468

FOREIGN PATENT DOCUMENTS

JP 2910472 6/1999
JP 2003-106299 4/2003
JP 2009-185713 8/2009

OTHER PUBLICATIONS

Chinese Office Action, dated Jul. 2, 2014, issued in corresponding Chinese Patent Application No. 201180009599.X, filed Feb. 17, 2011. English translation. Total 12 pages.

* cited by examiner

TURBOCOMPRESSOR AND TURBOREFRIGERATOR FOR SIMPLIFIED LABOR AND REDUCED COST

CROSS-REFERENCE TO RELATED APPLICATIONS

The present application is a 35 U.S.C. §§371 national phase conversion of PCT/JP2011/053371, filed Feb. 17, 2011, which claims priority of Japanese Patent Application No. 2010-032511, filed Feb. 17, 2010, the contents of which are incorporated herein by reference. The PCT International Application was published in the Japanese language.

FIELD OF THE INVENTION

The present invention relates to a turbocompressor and a turborefrigerator.

This application claims priority to and the benefits of Japanese Patent Application No. 2010-32511 filed on Feb. 17, 2010, the disclosure of which is incorporated herein by reference in its entirety.

BACKGROUND ART

As a refrigerator for cooling or freezing a cooling target such as water, a turborefrigerator having a turbocompressor which compressing and discharging a refrigerant by means of rotation of an impeller is known. The turbocompressor installed at this turborefrigerator includes, for instance, as shown in Patent Document 1, a motor installed in a motor casing, an impeller rotated by rotational power of the motor, and a pair of gears transmitting the rotational power of the motor to the impeller. One of the pair of gears is installed on a rotary shaft fixed to the impeller, and the other is installed on an output shaft of the motor.

PRIOR ART DOCUMENT

Patent Document

[Patent Document 1] Japanese Patent No. 2910472

DISCLOSURE OF THE INVENTION

Problems to be Solved by the Invention

Meanwhile, to secure smooth rotation of the intermeshing pair of gears, it is necessary to dispose the rotary shaft and the output shaft at a proper interval. Here, the impeller and the pair of gears are installed together in one impeller casing. Further, in the impeller casing, the rotary shaft is rotatably supported, and the motor casing is coupled using a predetermined positioning structure (e.g., a spigot joint structure). To install the rotary shaft and the output shaft at a proper interval, it is necessary to set a relative position between a supporting portion of the rotary shaft and the positioning structure for coupling the motor casing to an appropriate relation in the impeller casing. The impeller casing is formed by casting, and the supporting portion and the positioning structure are formed by a machining process (e.g., cutting) after the casting.

However, the supporting portion of the rotary shaft and the positioning structure for coupling the motor casing are disposed on opposite sides in an axial direction of the rotary shaft of the impeller casing, and a geometry of the impeller casing is large (an entire length of about 800 mm in the axial direction). As such, it is difficult for the supporting portion and the positioning structure to be wrought from one side at a time. For this reason, for example, after the supporting portion of the rotary shaft is wrought in the impeller casing, the impeller casing is inverted, and the positioning structure for coupling the motor casing is wrought based on a position of the wrought supporting portion. Thus, the working process becomes complicated.

The present invention has been made keeping in mind the above problems occurring in the related art, and an objective of the present invention is to provide a turbocompressor capable of simplifying a working process in manufacturing the turbocompressor and reducing labor and cost, and a turborefrigerator having the same.

Means for Solving the Problems

A turbocompressor according to the present invention includes a drive part generating rotational power, an impeller to which the rotational power of the drive part is transmitted to rotate, a plurality of gears transmitting the rotational power of the drive part to the impeller, and a drive part casing in which the drive part is installed, and further includes an impeller casing installed around the impeller, and a gear casing configured to be formed independently of the impeller casing and the drive part casing, to couple the impeller casing and the drive part casing, and to form an accommodation space in which the plurality of gears are accommodated.

In the present invention, the drive part casing, the impeller casing, and the gear casing are formed independently of one another. To secure smooth rotation of the plurality of gears, a relative position between positioning structures (e.g. spigot joint structures) for the drive part casing and the impeller casing is required to be set to a suitable relation in the gear casing coupling the drive part casing and the impeller casing. Here, since the gear casing is independent of the impeller casing, the entire length of the gear casing taken along the rotational axis of the drive part can be suppressed to a length at which the positioning structures are capable of being wrought from one side at once.

Further, the turbocompressor according to the present invention may include a rotary shaft configured to couple at least one of the plurality of gears and the impeller. The rotary shaft may be eccentric from a rotational axis of the drive part.

Further, the turbocompressor according to the present invention may include first threaded members configured to be screwed from a side of the accommodation space to fasten the impeller casing and the gear casing, and second threaded members configured to be screwed from an outside of the gear casing to fasten the impeller casing and the gear casing.

Further, the turbocompressor according to the present invention may include a circular seal member disposed at a coupling section between the impeller casing and the gear casing. The first threaded members may be disposed on a radially inner side of the seal member, and the second threaded members may be disposed on a radially outer side of the seal member.

At the coupling section of the turbocompressor according to the present invention, the seal member may be disposed in an annular shape.

In addition, a turborefrigerator according to the present invention includes a condenser cooling and liquefying a compressed refrigerant, and an evaporator evaporating the liquefied refrigerant to take heat of evaporation from a cooling target and thereby cool the cooling target, and further includes the turbocompressor having any structure described above as a compressor compressing the refrigerant evaporated at the evaporator and feeding the compressed refrigerant to the condenser.

Advantageous Effects

According to the present invention, in the gear casing, the positioning structures for the drive part casing and the impeller casing can each be wrought from one side at once. For this reason, in manufacturing the turbocompressor, the working process can be simplified, and the working labor and cost can be reduced.

BEST MODE FOR CARRYING OUT THE INVENTION

Hereinafter, an embodiment of the present invention will be described with reference to FIGS. 1 to 4. Note that, in each figure used in the following description, a scale of each member is appropriately changed to provide each member with a recognizable size.

Figure 1:
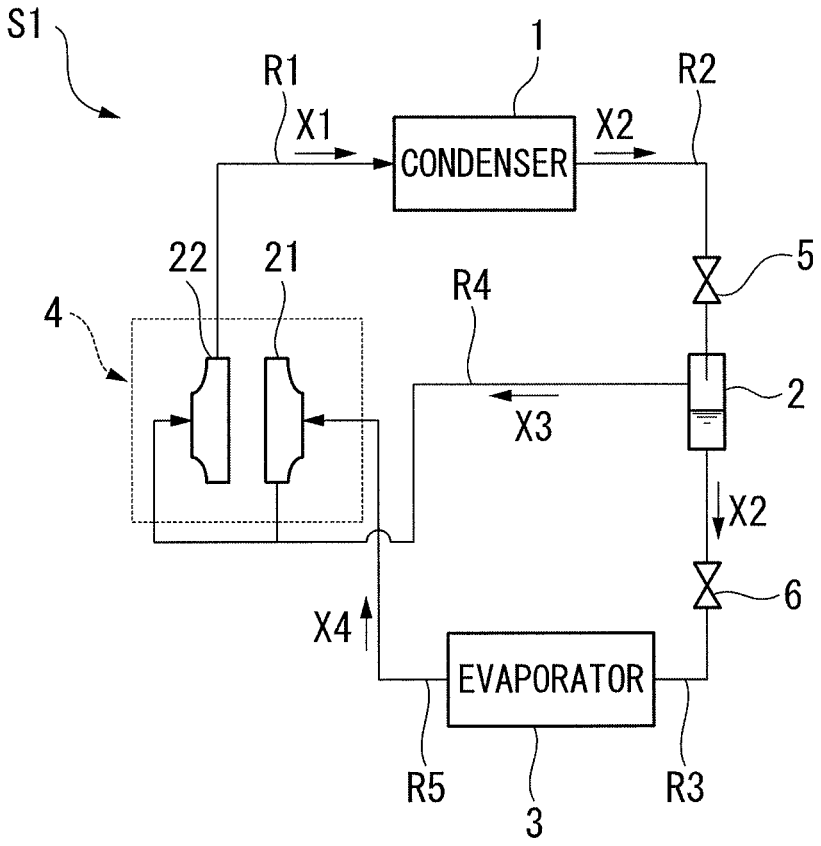
FIG. 1 is a block diagram showing a schematic configuration of a turborefrigerator in an embodiment of the present invention.

FIG. 1 is a block diagram showing a schematic configuration of a turborefrigerator S1 in the present embodiment. The turborefrigerator S1 in the present embodiment is installed in, for instance, a building or factory for producing cooling water for air-conditioning. As shown in FIG. 1, this turborefrigerator S1 includes a condenser 1, an economizer 2, an evaporator 3, and a turbocompressor 4.

A compressed refrigerant gas X1 that is a refrigerant of a compressed gas state is fed to the condenser 1. This compressed refrigerant gas X1 is cooled and liquefied by the condenser 1, thereby becoming a refrigerant liquid X2. As shown in FIG. 1, this condenser 1 is connected with the turbocompressor 4 via a channel R1 through which the compressed refrigerant gas X1 flows, and is connected with the economizer 2 via a channel R2 through which the refrigerant liquid X2 flows. Further, an expansion valve 5 for decompressing the refrigerant liquid X2 is installed on the channel R2.

The economizer 2 temporarily accumulates the refrigerant liquid X2 decompressed at the expansion valve 5. This economizer 2 is connected with the evaporator 3 via a channel R3 through which the refrigerant liquid X2 flows, and is connected with the turbocompressor 4 via a channel R4 through which a gaseous component X3 of the refrigerant which is produced at the economizer 2 flows. Further, an expansion valve 6 for further decompressing the refrigerant liquid X2 is installed on the channel R3. Further, the channel R4 is connected with the turbocompressor 4 so as to feed the gaseous component X3 to a second compression stage 22 which will be described below and with which the turbocompressor 4 is provided.

The evaporator 3 cools a cooling target such as water by evaporating the refrigerant liquid X2 to take heat of evaporation from the cooling target. This evaporator 3 is connected with the turbocompressor 4 via a channel R5 through which a refrigerant gas X4 produced by the evaporation of the refrigerant liquid X2 flows. Further, the channel R5 is connected with a first compression stage 21 which will be described below and with which the turbocompressor 4 is provided.

The turbocompressor 4 compresses the refrigerant gas X4 to become the compressed refrigerant gas X1. As described above, this turbocompressor 4 is connected with the condenser 1 via the channel R1 through which the compressed refrigerant gas X1 flows, and is connected with the evaporator 3 via the channel R5 through which the refrigerant gas X4 flows.

In the turborefrigerator S1 configured in this way, the compressed refrigerant gas X1 fed to the condenser 1 via the channel R1 is liquefied and cooled by the condenser 1, becoming the refrigerant liquid X2.

When fed to the economizer 2 via the channel R2, the refrigerant liquid X2 is decompressed by the expansion valve 5, and is temporarily accumulated in the economizer 2 in a decompressed state. Then, when fed to the evaporator 3 via the channel R3, the refrigerant liquid X2 is further decompressed by the expansion valve 6, and is fed to the evaporator 3 in a further decompressed state.

The refrigerant liquid X2 fed to the evaporator 3 is evaporated by the evaporator 3, becoming the refrigerant gas X4. The refrigerant gas X4 is fed to the turbocompressor 4 via the channel R5.

The refrigerant gas X4 fed to the turbocompressor 4 is compressed by the turbocompressor 4, becoming the compressed refrigerant gas X1. The compressed refrigerant gas X1 is fed to the condenser 1 via the channel R1 again.

Further, the gaseous component X3 of the refrigerant which is generated when the refrigerant liquid X2 is accumulated in the economizer 2 is fed to the turbocompressor 4 via the channel R4, is compressed along with the refrigerant gas X4, and then is fed to the condenser 1 via the channel R1 as the compressed refrigerant gas X1.

Thus, in the turborefrigerator S1, when the refrigerant liquid X2 is evaporated at the evaporator 3, the heat of evaporation is taken from the cooling target. Thereby, the cooling target is cooled or frozen.

Figure 2:
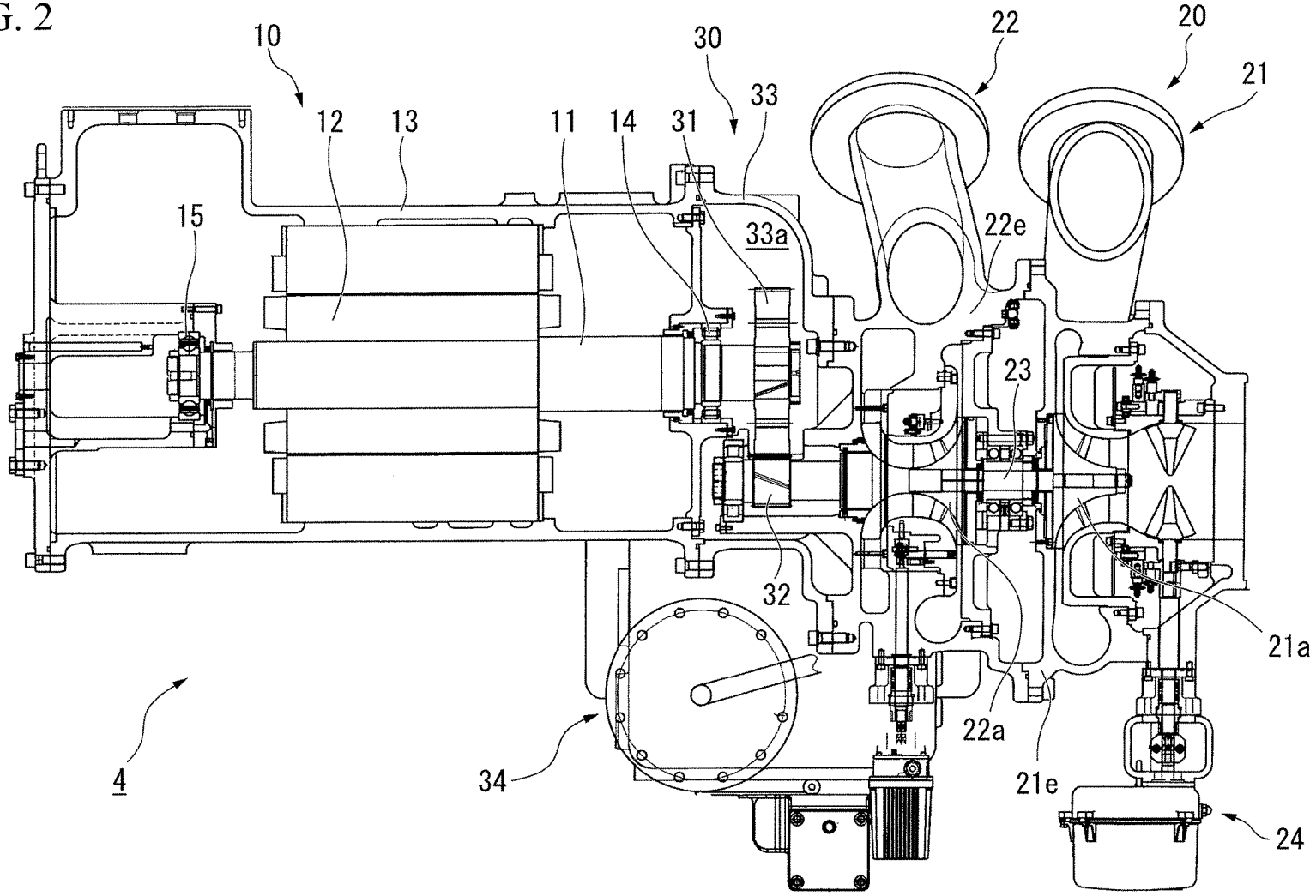
FIG. 2 is a horizontal cross-sectional view of a turbocompressor in the embodiment of the present invention.
Figure 3:
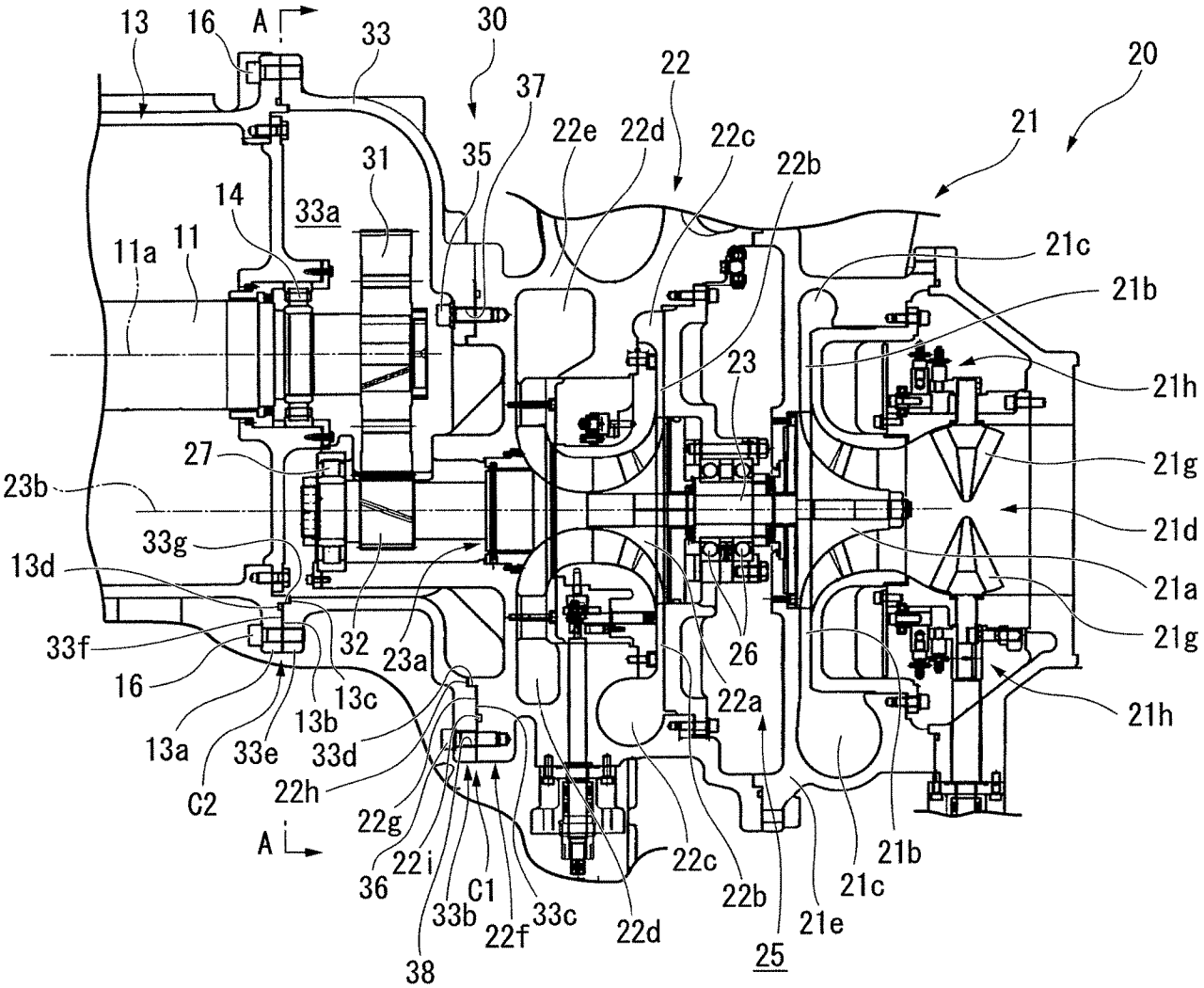
FIG. 3 is an enlarged horizontal cross-sectional view showing a compressor unit and a gear unit which the turbocompressor includes in the embodiment of the present invention.
Figure 4:
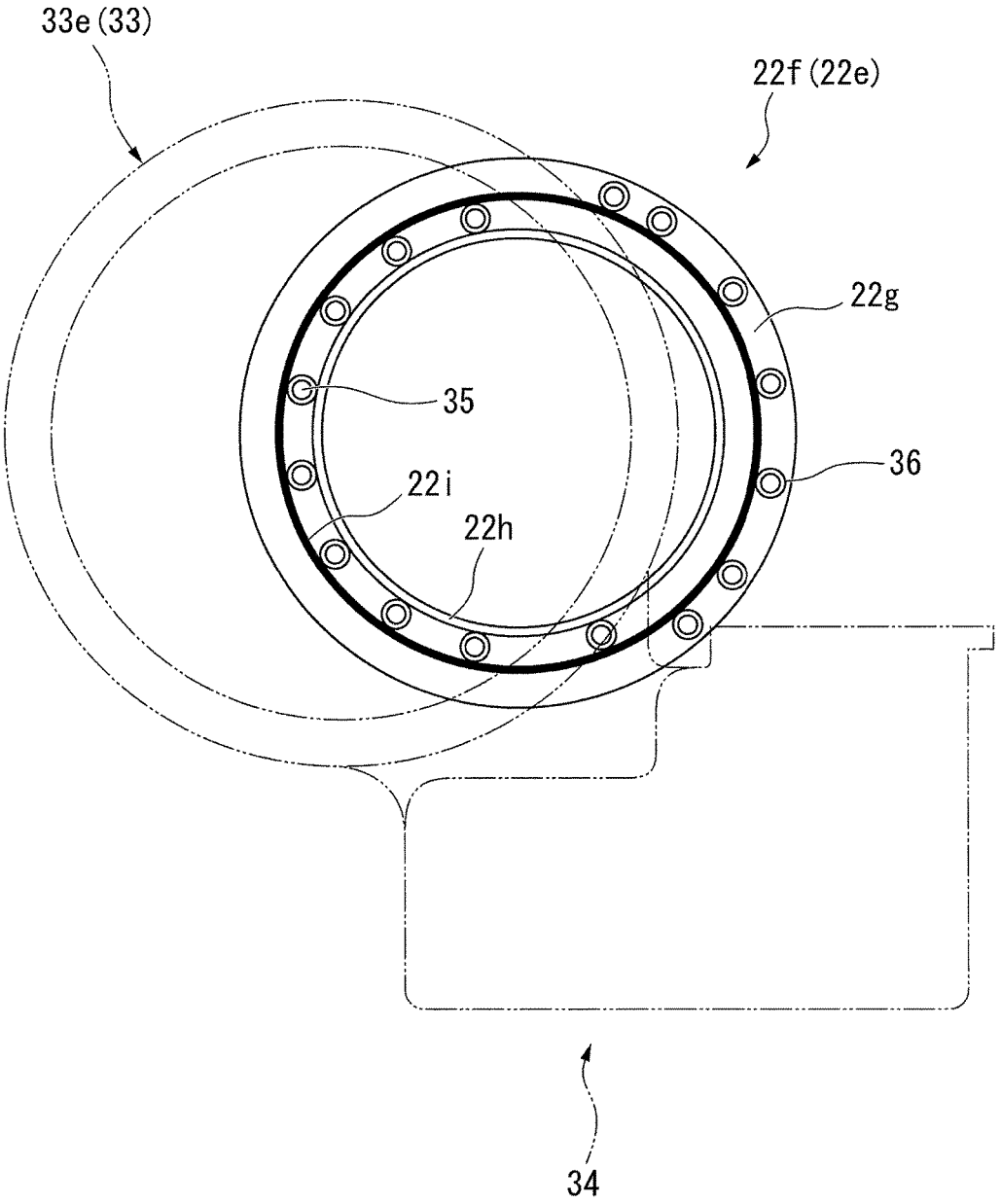
FIG. 4 is a cross-sectional view taken along line A-A of FIG. 3.

Next, the turbocompressor 4 that is a feature of the present embodiment will be described in greater detail. FIG. 2 is a horizontal cross-sectional view of the turbocompressor 4. Further, FIG. 3 is an enlarged horizontal cross-sectional view showing a compressor unit 20 and a gear unit 30 with which the turbocompressor 4 is provided. Also, FIG. 4 is a cross-sectional view taken along line A-A of FIG. 3. In FIG. 4, a second impeller casing 22*e* depicts only a first collar part 22*f*, and a gear casing 33 is expressed by an imaginary line.

As shown in FIG. 2, the turbocompressor 4 in the present embodiment includes a motor unit 10, a compressor unit 20, and a gear unit 30.

The motor unit 10 includes a motor (drive part) 12 that has an output shaft 11 and serves as a drive source for driving the compressor unit 20, and a motor casing (drive part casing) 13 which surrounds the motor 12 and in which the motor 12 is installed. Further, the drive part driving the compressor unit 20 is not limited to the motor 12, and may be, for instance, an internal combustion engine.

The output shaft 11 of the motor 12 is rotatably supported by first and second bearings 14 and 15 fixed to the motor casing 13.

The compressor unit 20 includes a first compression stage 21 that suctions and compresses the refrigerant gas X4 (see FIG. 1), and a second compression stage 22 that further compresses the refrigerant gas X4 compressed at the first compression stage 21 and discharges the compressed refrigerant gas X4 as the compressed refrigerant gas X1 (see FIG. 1).

As shown in FIG. 3, the first compression stage 21 includes a first impeller 21*a* that gives velocity energy to the refrigerant gas X4 fed in a thrust direction and discharges the refrigerant gas X4 in a radial direction, a first diffuser 21*b* that compresses the refrigerant gas X4 by converting the velocity energy given to the refrigerant gas X4 by the first impeller 21*a* into pressure energy, a first scroll chamber 21*c* that leads the refrigerant gas X4 compressed by the first diffuser 21*b* to an outside of the first compression stage 21, and a suction inlet 21*d* that suctions the refrigerant gas X4 and feeds the refrigerant gas X4 to the first impeller 21*a*.

Further, parts of the first diffuser 21*b*, the first scroll chamber 21*c*, and the suction inlet 21*d* are formed by a first impeller casing 21*e* surrounding the first impeller 21*a*.

A rotary shaft 23 extending through the first and second compression stages 21 and 22 is installed in the compressor unit 20. The first impeller 21*a* is fixed to the rotary shaft 23, and rotational power from the output shaft 11 of the motor 12 is transmitted to the rotary shaft 23. Thereby, the first impeller 21*a* is rotated.

Further, a plurality of inlet guide vanes 21*g* for adjusting a suction capacity of the first compression stage 21 are installed in the suction inlet 21*d* of the first compression stage 21.

Each inlet guide vane 21*g* is rotatably configured so that an apparent area from a flow direction of the refrigerant gas X4 can be changed by a drive mechanism 21*h* fixed to the first impeller casing 21*e*. Further, a vane drive part 24 (see FIG. 2) that rotates each inlet guide vane 21*g* coupled with the drive mechanism 21*h* is installed outside the first impeller casing 21*e*.

The second compression stage 22 includes a second impeller (impeller) 22*a* that gives velocity energy to the refrigerant gas X4 fed in a thrust direction after being compressed at the first compression stage 21 and discharges the refrigerant gas X4 in a radial direction, a second diffuser 22*b* that compresses the refrigerant gas X4 by converting the velocity energy given to the refrigerant gas X4 by the second impeller 22*a* into pressure energy and discharges the compressed refrigerant gas X4 as the compressed refrigerant gas X1, a second scroll chamber 22*c* that leads the compressed refrigerant gas X1 discharged from the second diffuser 22*b* to the outside of the second compression stage 22, and an introduction scroll chamber 22*d* that introduces the refrigerant gas X4 compressed at the first compression stage 21 into the second impeller 22*a*.

Further, the second diffuser 22*b*, the second scroll chamber 22*c*, and the introduction scroll chamber 22*d* are formed by a second impeller casing (impeller casing) 22*e* surrounding the second impeller 22*a*.

The second impeller 22*a* is fixed to the aforementioned rotary shaft 23 so as to become coupled back-to-back with the first impeller 21*a*, and the rotational power from the output shaft 11 of the motor 12 is transmitted to the rotary shaft 23. Thereby, the second impeller 22*a* is rotated.

The second scroll chamber 22*c* is connected with the channel R1 (see FIG. 1) for feeding the compressed refrigerant gas X1 to the condenser 1, and feeds the compressed refrigerant gas X1 led from the second compression stage 22 to the channel R1.

Further, the first scroll chamber 21*c* of the first compression stage 21 and the introduction scroll chamber 22*d* of the second compression stage 22 are connected via an external piping (not shown) installed independently of the first compression stage 21 and the second compression stage 22, and the refrigerant gas X4 compressed at the first compression stage 21 is fed to the second compression stage 22 via this external piping. The aforementioned channel R4 (see FIG. 1) is connected to this external piping, and the gaseous component X3 of the refrigerant which is generated at the economizer 2 is fed to the second compression stage 22 via the external piping.

Further, the rotary shaft 23 is rotatably supported in a space 25 between the first compression stage 21 and the second compression stage 22 by a third bearing 26 fixed to the second impeller casing 22*e* of the second compression stage 22 and a fourth bearing 27 fixed to the second impeller casing 22*e* on a side of the gear unit 30. The rotary shaft 23 is provided with a labyrinth seal 23*a* for inhibiting the refrigerant gas X4 from flowing from the introduction scroll chamber 22*d* to the side of the gear unit 30.

The gear unit 30 includes a large diameter gear (gear) 31 fixed to the output shaft 11 of the motor 12, a small diameter gear (gear) 32 fixed to the rotary shaft 23 and meshed with the large diameter gear 31, and a gear casing 33 housing the large and small diameter gears 31 and 32, and transmits the rotational power of the output shaft 11 of the motor 12 to the rotary shaft 23.

The large diameter gear 31 has an outer diameter greater than the small diameter gear 32. The large diameter gear 31 and the small diameter gear 32 cooperate with each other, and thereby the rotational power of the motor is transmitted to the rotary shaft 23 so that the number of rotations of the rotary shaft 23 increases relative to that of the output shaft 11. The transmission of the rotational power of the motor 12 to the rotary shaft 23 is not limited to this transmitting method. A plurality of gear diameters may be set so that the number of rotations of the rotary shaft 23 is equal to or less than that of the output shaft 11.

To secure smooth rotation of the large and small intermeshing diameter gears 31 and 32, an interval between these is set to an appropriate value. Since the large diameter gear 31 is fixed to the output shaft 11 and the small diameter gear 32 is fixed to the rotary shaft 23, an axis 23*b* of the rotary shaft 23 is eccentrically provided apart from an axis (rotational axis) 11*a* of the output shaft 11 at a predetermined interval.

The gear casing 33 is formed therein with an accommodation space 33*a* for accommodating the large and small diameter gears 31 and 32. Further, an oil tank 34 (see FIG. 2), in which a lubricant fed to a sliding region of the turbocompressor 4 is collected and stored, is connected to the gear casing 33.

The gear casing 33 is formed independently of the motor casing 13 and the second impeller casing 22*e*, and couples the motor casing 13 and the second impeller casing 22*e*. That is, the gear casing 33 is coupled with the second impeller casing 22*e* at a first coupling section (coupling section) C1, and is coupled with the motor casing 13 at a second coupling section C2.

As shown in FIG. 3, the second impeller casing 22*e* is provided with a circular first collar part 22*f*, which is coupled with the gear casing 33 at the first coupling section C1. On the other hand, the gear casing 33 is provided with a circular second collar part 33*b*, which is coupled with the first collar part 22*f* of the second impeller casing 22*e* at the first coupling section C1.

The first collar part 22*f* includes a circular first abutment face 22*g* formed in a shape of a plane facing the second collar part 33*b*, and a first convex part 22*h* that is formed throughout the circumference on a radially inner side of the first abutment face 22*g* and protrudes toward the second collar part 33*b*.

The second collar part 33*b* includes a second abutment face 33*c* that is formed in a shape of a plane parallel to the first abutment face 22*g* and comes in contact with the first abutment face 22*g*, and a first concave part 33*d* which is formed throughout the circumference on a radially inner side of the second abutment face 33*c* and with which the first convex part 22*h* is fitted in close contact (or with a minute clearance allowable in view of precision).

An annular first seal member (seal member) 22*i* air-tightly maintaining the first coupling section C1 is installed between the first abutment face 22*g* and the second abutment face 33*c*. The first seal member 22*i* is disposed in an annular groove part (not shown) formed in the first abutment face 22*g*.

Further, when the second impeller casing 22*e* and the gear casing 33 are coupled at the first coupling section C1, a plurality of first bolts (first threaded members) 35 that are screwed from the side of the accommodation space 33*a* and fasten the first collar part 22*f* and the second collar part 33*b* and a plurality of second bolts (second threaded members) 36 that are screwed from the outside of the gear casing 33 and fasten the first collar part 22*f* and the second collar part 33*b* are used. The second bolts 36 may be screwed from the outside of the second impeller casing 22*e*.

As shown in FIG. 4, the plurality of first bolts 35 are disposed on a radially inner side of the first seal member 22*i*, whereas the plurality of second bolts 36 are disposed on a radially outer side of the first seal member 22*i*.

Since the first bolts 35 are screwed from the side of the accommodation space 33*a*, predetermined flange parts for installing bolts (threaded members) screwed from the outside of the turbocompressor 4 are not required to be formed on outer portions of the second impeller casing 22*e* and the gear casing 33, respectively. As a result, each casing can be made small. Further, the first and second bolts 35 and 36 are screwed into the second impeller casing 22*e* and the gear casing 33 in the same direction. For this reason, the screwing work of the first and second bolts 35 and 36 can be carried out from one side (left side in FIGS. 1 and 2) at once, and thus workability is improved.

As shown in FIG. 3, the motor casing 13 is provided with a circular first flange part 13*a* coupled with the gear casing 33 at the second coupling section C2. On the other hand, the gear casing 33 is provided with a circular second flange part 33*e* coupled with the first flange part 13*a* of the motor casing 13 at the second coupling section C2.

The first flange part 13*a* includes a circular third abutment face 13*b* that is formed in a shape of a plane facing the second flange part 33*e*, and a second convex part 13*c* that is formed throughout the circumference on a radially inner side of the circular third abutment face 13*b* and protrudes toward the second flange part 33*e*.

The second flange part 33*e* includes a fourth abutment face 33*f* that is formed in a shape of a plane parallel to the third abutment face 13*b* and comes in contact with the third abutment face 13*b*, and a second concave part 33*g* which is formed throughout the circumference on a radially inner side of the fourth abutment face 33*f* and with which the second convex part 13*c* is fitted in close contact (or with a minute clearance allowable in view of precision).

An annular second seal member 13*d* air-tightly maintaining the second coupling section C2 is installed between the third abutment face 13*b* and the fourth abutment face 33*f*. The second seal member 13*d* is disposed in an annular groove portion (not shown) formed in the third abutment face 13*b*.

Further, when the motor casing 13 and the gear casing 33 are coupled at the second coupling section C2, a plurality of third bolts 16 that are screwed from the outside of the motor casing 13 and fasten the first and second flange parts 13*a* and 33*e* are used. The plurality of third bolts 16 are disposed on a radially outer side of the second seal member 13*d*.

The first convex part 22*h* is fitted into the first concave part 33*d* at the first coupling section C1, and the second convex part 13*c* is fitted into the second concave part 33*g* at the second coupling section C2. Thereby, the second impeller casing 22*e* and the motor casing 13 are positioned relative to the gear casing 33. As a result of this positioning, an interval between the output shaft 11 and the rotary shaft 23, i.e. an interval between the large diameter gear 31 and the small diameter gear 32, is set to an appropriate value at which smooth rotation can be secured.

Further, to set the interval between the large and small diameter gears 31 and 32 to the appropriate value, a relative position between the first concave part 33*d* and the second concave part 33*g* is required to be set to an appropriate relation in the gear casing 33. Hereinafter, a process of forming the gear casing 33 will be described.

First, the gear casing 33 is molded by a casting method (sand casting, die casting, etc.). In the casting method, it is difficult to mold the second collar part 33*b* and the second flange part 33*e* in high precision. For this reason, these parts are wrought and formed by a machining process (cutting, grinding, etc.).

Next, the second abutment face 33*c* and the fourth abutment face 33*f* are wrought and formed by a machining process (cutting, e.g., face milling). In this machining process, the second abutment face 33*c* and the fourth abutment face 33*f* are formed so as to be parallel to each other. In this case, one of the abutment faces 33*c* and 33*f* is wrought, and then the other abutment face is wrought. To this end, the gear casing 33 is required to be inverted. However, the gear casing 33 of the present embodiment is formed independently of the second impeller casing 22*e*, which has been integrally formed with the gear casing in the related art. As such, a size and weight of the gear casing 33 are reduced together, and labor of the inverting work is reduced.

Next, the first concave part 33*d* and the second concave part 33*g* are wrought and formed by a machining process (cutting, e.g., boring). In this case, the gear casing 33 is fixed to a predetermined working apparatus, and, for example, the second concave part 33*g* of the motor casing 13 side that is one side is wrought and formed. Afterwards, the gear casing 33 continues to be fixed to the predetermined machining apparatus, and a working tool with which the second concave part 33*g* has been wrought is horizontally displaced, is inserted into the accommodation space 33*a* of the gear casing 33, and is caused to protrude to the side of the second impeller casing 22*e* via the accommodation space 33*a*. Moreover, while displacing the working tool to the side of the motor casing 13, the first concave part 33*d* is wrought and formed (so-called back boring).

In working the first and second concave parts 33*d* and 33*g*, the inversion of the gear casing 33 is not required. Further, a relative positional relation between the first concave part 33*d* and the second concave part 33*g* is set to the working apparatus in advance. Thereby, the first concave part 33*d* is wrought at a proper position based on a position of the second concave part 33*g* wrought first. That is, the first and second concave parts 33*d* and 33*g* can be wrought from one side at once.

Finally, through-holes 37, 38 into which the first and second bolts 35 and 36 are inserted are formed in the second collar part 33*b*, and internally threaded holes (not shown) into which the third bolts 16 are screwed are formed in the second flange part 33*e*.

In this way, the formation of the gear casing 33 is terminated. In the present embodiment, the first and second concave parts 33*d* and 33*g* in the gear casing 33 can be wrought from one side at once.

For this reason, in manufacturing the turbocompressor 4, the working process can be simplified, and working labor and cost can be reduced.

Further, since the second impeller casing 22*e* is also formed by a casting method, all of the groove parts in the first collar part 22*f* in which the first abutment face 22*g*, the first convex part 22 and the first seal member 22*i* are disposed, are formed by a machining process. Here, since the groove part in which the first seal member 22*i* is disposed is formed in an annular shape, the groove part can be wrought in a simple way and at a low cost, compared to a groove part having a polygonal shape or a groove part in which arcs having different diameters are connected.

Next, in the present embodiment, an operation of the turbocompressor 4 will be described.

First, the rotational power of the motor 12 is transmitted to the rotary shaft 23 via the large and small diameter gears 31 and 32. Thereby, the first and second impellers 21*a* and 22*a* of the compressor unit 20 are rotated.

When the first impeller 21*a* is rotated, the suction inlet 21*d* of the first compression stage 21 is placed under a negative pressure, and the refrigerant gas X4 flows from the channel R5 to the first compression stage 21 via the suction inlet 21*d*.

The refrigerant gas X4 flowing into the first compression stage 21 flows to the first impeller 21*a* in a thrust direction, is given velocity energy by the first impeller 21*a*, and is discharged in a radial direction.

The refrigerant gas X4 discharged from the first impeller 21*a* is compressed by the first diffuser 21*b* converting the velocity energy into pressure energy.

The refrigerant gas X4 discharged from the first diffuser 21*b* is led to the outside of the first compression stage 21 via the first scroll chamber 21*c*.

Then, the refrigerant gas X4 led to the outside of the first compression stage 21 is fed to the second compression stage 22 via the external piping.

The refrigerant gas X4 fed to the second compression stage 22 flows to the second impeller 22*a* via the introduction scroll chamber 22*d* in a thrust direction, is given velocity energy by the second impeller 22*a*, and is discharged in a radial direction.

The refrigerant gas X4 discharged from the second impeller 22*a* is further compressed by the second diffuser 22*b* converting the velocity energy into pressure energy, thereby becoming the compressed refrigerant gas X1.

The compressed refrigerant gas X1 discharged from the second diffuser 22*b* is led to the outside of the second compression stage 22 via the second scroll chamber 22*c*.

Then, the compressed refrigerant gas X1 led to the outside of the second compression stage 22 is fed to the condenser 1 via the channel R1.

In this way, the operation of the turbocompressor 4 is terminated.

Here, an airtight operation of the first seal member 22*i* at the first coupling section C1 will be described.

A flow of the refrigerant gas X4, which is introduced into the introduction scroll chamber 22*d*, to the side of the gear unit 30 is inhibited by the labyrinth seal 23*a* installed on the rotary shaft 23. However, an airtight operation of the labyrinth seal 23*a* is not complete. Particularly, when the number of rotations of the rotary shaft 23 is low, the refrigerant gas X4 flows into the accommodation space 33*a* of the gear casing 33. For this reason, an internal pressure of the accommodation space 33*a* becomes higher compared to the outside of the turbocompressor 4, and the refrigerant gas X4 starts to leak to the outside via the first and second coupling sections C1 and C2.

At the second coupling section C2, a positional relation between the second seal member 13*d* and the third bolts 16 is typical, and the leakage of the refrigerant gas X4 can be sufficiently prevented.

On the other hand, the first bolts 35 at the first coupling section C1 are screwed from the side of the accommodation space 33*a*, and the refrigerant gas X4 starts to leak to the outside by flowing into the through-holes formed in the second collar part 33*b* into which the first bolts 35 are inserted and by passing through a space between the first abutment face 22*g* and the second abutment face 33*c*. However, in the present embodiment, since the first bolts 35 are installed on the radially inner side of the first seal member 22*i*, the leakage of the refrigerant gas X4 to the outside via the through-holes and the space between the first abutment face 22*g* and the second abutment face 33*c* can be prevented.

At the first coupling section C1, a positional relation between the first seal member 22*i* and the second bolts 36 is typical, and the leakage of the refrigerant gas X4 can be sufficiently prevented.

According to the present embodiment, the following effects can be obtained.

According to the present embodiment, the first and second concave parts 33*d* and 33*g* of the gear casing 33 can be wrought from one side at once. For this reason, in manufacturing the turbocompressor 4 and the turborefrigerator S1 having the turbocompressor 4, the working process can be simplified, and the working labor and cost can be reduced.

While the exemplary embodiments of the present invention have been described with reference to the attached drawings, it goes without saying that the present invention is not limited to related examples. The shapes or their combinations of components shown in the aforementioned examples are merely illustrative, and it will be understood by those skilled in the art that various modifications based on the requirements of design may be made therein without departing from the spirit and scope of the present invention.

For example, in the embodiment, the large and small diameter gears 31 and 32 are used. However, the present invention is not limited to this configuration. To transmit the rotational power of the motor 12 to the rotary shaft 23, still more gears (three or more gears) may be used. Further, instead of the gears, for example, a transmission means using a pulley and a belt or a chain may be used.

Further, in the embodiment, the annular first seal member 22*i* is used at the first coupling section C1. However, the present invention is not limited to this configuration. The first and second bolts 35 and 36 are disposed on one annular path, and the circular seal member installed on the first coupling section C1 may be a non-annular seal member having a portion disposed on a radially inner side of the annular path and a portion disposed on a radially outer side of the annular path. With this configuration, the labor of working a groove part in which the non-annular seal member is disposed is increased. However, since the first and second bolts 35 and 36 are disposed on one annular path, radial widths of the first and second collar parts 22*f* and 33*b* may be narrowed, compared to those of the embodiment.

Further, in the embodiment, the turbocompressor 4 is a two-stage compression type turbocompressor having the first and second compression stages 21 and 22. However, the present invention is not limited to this type of compressor, and may be a one-stage compression type or a multi-stage compression type of three or more stages.

INDUSTRIAL APPLICABILITY

According to the present invention, the positioning structures for the drive part casing and the impeller casing in the gear casing of the turbocompressor can each be wrought from one side at once. For this reason, in manufacturing the turbocompressor, the working process can be simplified, and the working labor and cost can be reduced.

DESCRIPTION OF REFERENCE NUMERALS

1 . . . condenser, 3 . . . evaporator, 4 . . . turbocompressor, 11*a* . . . axis (rotational axis), 12 . . . motor (drive part), 13 . . . motor casing (drive part casing), 22*a* . . . second impeller (impeller), 22*e* . . . second impeller casing (impeller casing), 22*i* . . . first seal member (seal member), 23 . . . rotary shaft, 23*a* . . . axis, 31 . . . large diameter gear (gear), 32 . . . small diameter gear (gear), 33 . . . gear casing, 33*a* . . . accommodation space, 35 . . . first bolt (first threaded member), 36 . . . second bolt (second threaded member), C1 . . . first coupling section (coupling section), S1 . . . turborefrigerator

The invention claimed is:

1. A turbocompressor having a drive part having an output shaft and generating rotational power from the output shaft, an impeller to which the rotational power of the output shaft is transmitted to rotate, a plurality of gears transmitting the rotational power of the drive part to the impeller, and a drive part casing which surrounds the drive part and in which the drive part is installed, the turbocompressor comprising:

an impeller casing installed around the impeller;

a gear casing configured to be formed independently of the impeller casing and the drive part casing, to couple the impeller casing and the drive part casing, and to form an accommodation space in which the plurality of gears are accommodated; and a first bearing and a second bearing which support the output shaft rotatably, wherein the first bearing and the second bearing are fixed to the drive part casing, the gear casing has a tubular shape in which both a first end and a second end of the gear casing in a rotational axis direction of the output shaft are opened, the impeller casing is provided with a circular first collar part coupled with the first end of the gear casing, the drive part casing is provided with a circular first flange part coupled with the second end of the gear casing, the drive part casing faces the accommodation space, the first end of the gear casing is provided with a circular second collar part coupled with the first collar part, the second end of the gear casing is provided with a circular second flange part coupled with the first flange part, the first collar part includes a circular first abutment face facing the second collar part, and a first convex part that protrudes beyond the first abutment face toward the second collar part, the second collar part includes a second abutment face being in contact with the first abutment face, and a first concave part in which the first convex part is inserted, the first convex part is fitted with the first concave part, the first flange part includes a circular third abutment face facing the second flange part, and a second convex part that protrudes beyond the third abutment face toward the second flange part, the second flange part includes a fourth abutment face being in contact with the third abutment face, and a second concave part in which the second convex part is inserted, and the second convex part is fitted with the second concave part.

2. The turbocompressor according to claim 1, comprising:

first threaded members to fasten the impeller casing and the gear casing to each other;

second threaded members to fasten the impeller casing and the gear casing to each other;

a rotary shaft configured to couple at least one of the plurality of gears and the impeller; and a circular seal member disposed between the first abutment face and the second abutment face, wherein the rotary shaft has an axis eccentric from the rotational axis of the output shaft, first through-holes, in which the first threaded members are respectively inserted, are formed in the second collar part, second through-holes, in which the second threaded members are respectively inserted, are formed in the second collar part, first ends of the first through-holes face the accommodation space, first ends of the second through-holes face an outside of the gear casing, the first threaded members are screwed from a side of the accommodation space through the first through-holes respectively and fasten the first collar part and the second collar part to each other, the second threaded members are screwed from an outside of the gear casing through the second through-holes respectively and fasten the first collar part and the second collar part to each other, and the first threaded members are disposed on a radially inner side of the seal member, and the second threaded members are disposed on a radially outer side of the seal member.

3. The turbocompressor according to claim 2, wherein the seal member is disposed in an annular shape between the first abutment face and the second abutment face.

4. A turborefrigerator comprising:

a condenser cooling and liquefying a compressed refrigerant;

an evaporator evaporating the liquefied refrigerant to take heat of evaporation from a cooling target and thereby cooling the cooling target; and the turbocompressor set forth in claim 1, the turbo compressor compressing the refrigerant evaporated at the evaporator and feeding the compressed refrigerant to the condenser.

5. The turbocompressor according to claim 2, wherein the first threaded members and the second threaded members are disposed around the rotary shaft.

6. The turbocompressor according to claim 2, wherein the first threaded members and the second threaded members pass through the first abutment face and the second abutment face.

7. The turbocompressor according to claim 1, wherein the first convex part is formed on a radially inner side of the first abutment face, the first concave part is formed on a radially inner side of the second abutment face.

8. The turbocompressor according to claim 7, wherein the first convex part is formed throughout a circumference, and the first concave part is formed throughout a circumference.

9. The turbocompressor according to claim 1, further comprising:

a rotary shaft configured to couple at least one of the plurality of gears and the impeller; and a third bearing and a fourth bearing which support the rotary shaft rotatably, wherein the third bearing and the fourth bearing are fixed to the impeller casing.

* * * * *